US006782852B2

(12) United States Patent
Van Weelden

(10) Patent No.: US 6,782,852 B2
(45) Date of Patent: Aug. 31, 2004

(54) HYDRAULIC ACTUATOR FOR OPERATING AN ENGINE CYLINDER VALVE

(75) Inventor: Curtis L. Van Weelden, Sussex, WI (US)

(73) Assignee: Husco International, Inc., Waukesha, WI (US)

( * ) Notice: Subject to any disclaimer, the term of this patent is extended or adjusted under 35 U.S.C. 154(b) by 150 days.

(21) Appl. No.: 10/266,067

(22) Filed: Oct. 7, 2002

(65) Prior Publication Data

US 2004/0065855 A1 Apr. 8, 2004

(51) Int. Cl.[7] ..... F02L 9/06; F15B 13/04

(52) U.S. Cl. ..... 123/90.11; 123/90.12; 251/30.01

(58) Field of Search ..... 251/30.01; 123/90.11, 123/90.12; 137/625.64, 625.65, 625.25, 625.26, 625.27, 625.67–625.69

(56) References Cited

U.S. PATENT DOCUMENTS

| | | | | |
|---|---|---|---|---|
| 4,200,067 | A | | 4/1980 | Trenne |
| 4,206,728 | A | | 6/1980 | Trenne |
| 4,476,823 | A | | 10/1984 | Williams |
| 5,012,778 | A | | 5/1991 | Pitzi |
| 5,191,867 | A | | 3/1993 | Glassev |
| 5,224,683 | A | | 7/1993 | Richeson |
| 5,231,959 | A | | 8/1993 | Smietana |
| 5,248,123 | A | | 9/1993 | Richeson et al. |
| 5,287,829 | A | | 2/1994 | Rose |
| 5,335,633 | A | | 8/1994 | Thien |
| 5,339,777 | A | | 8/1994 | Cannon |
| 5,392,749 | A | | 2/1995 | Stockner et al. |
| 5,410,994 | A | | 5/1995 | Schechter |
| 5,419,301 | A | | 5/1995 | Schechter |
| 5,421,359 | A | | 6/1995 | Meister et al. |
| 5,448,973 | A | | 9/1995 | Meyer |
| 5,456,221 | A | | 10/1995 | Schechter |
| 5,456,222 | A | | 10/1995 | Schechter |
| 5,456,223 | A | | 10/1995 | Miller et al. |
| 5,509,637 | A | | 4/1996 | Leonard |
| 5,529,030 | A | | 6/1996 | Rose |
| RE35,303 | E | | 7/1996 | Miller et al. |
| 5,542,382 | A | | 8/1996 | Clarke |
| 5,582,141 | A | | 12/1996 | Meyer |
| 5,595,148 | A | | 1/1997 | Letsche et al. |
| 5,619,965 | A | | 4/1997 | Cosma et al. |
| 5,636,602 | A | | 6/1997 | Meister |
| 5,638,781 | A | | 6/1997 | Sturman |
| 5,713,316 | A | | 2/1998 | Sturman |
| 5,906,351 | A | * | 5/1999 | Aardema et al. ..... 251/30.01 |
| 5,960,753 | A | | 10/1999 | Sturman |
| 5,970,956 | A | | 10/1999 | Sturman |
| 6,044,815 | A | | 4/2000 | De Ojeda |
| 6,135,073 | A | | 10/2000 | Feucht et al. |
| 6,263,842 | B1 | | 7/2001 | De Ojeda et al. |
| 6,364,280 | B1 | * | 4/2002 | Stach ..... 251/50 |

* cited by examiner

*Primary Examiner*—Paul J. Hirsch
(74) *Attorney, Agent, or Firm*—George E. Haas; Quarles & Brady LLP

(57) ABSTRACT

A hydraulic actuator operates either an intake or an exhaust valve for an engine cylinder. A driver piston is adapted to be operably connected to open and close the engine cylinder valve. An electrically driven operator produces movement of a valve spool which controls flow of fluid to and from the driver piston. A feedback mechanism is coupled to the valve spool and responds to movement of the driver piston by moving the valve spool into a position at which fluid flows neither to nor from the driver piston. The feedback mechanism ensures that the stroke of the hydraulic actuator is proportional to the magnitude of the electric current applied to the operator regardless of variation of the fluid pressure applied to the driver piston.

20 Claims, 6 Drawing Sheets

HYDRAULIC ACTUATOR FOR OPERATING AN ENGINE CYLINDER VALVE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic actuators, and more particularly to hydraulic actuators for operating an intake or exhaust valve for a cylinder of an internal combustion engine.

2. Description of the Related Art

Internal combustion engines have a plurality of cylinders containing pistons that are connected to a crankshaft. Each cylinder has two or more valves to control the air flow into the cylinder and the flow of exhaust gases from the cylinder. Traditionally the cylinder valves were controlled by a cam shaft which in turn was mechanically connected to rotate with the engine crankshaft. Gears, chains, or belts coupled the crankshaft to the cam shaft so that the two would rotate in unison. It is important that the valves open and close at the proper times during the combustion cycle within each cylinder. Heretofore, that timing relationship was fixed by the mechanical coupling between the crankshaft and the cam shaft.

The setting of the cam shaft timing often was a compromise which produced the best overall operation at all engine operating speeds and conditions. However, it was recognized that optimum engine performance could be obtained if the valve timing was varied as a function of engine speed, engine load and other factors.

The trend in motor vehicles is toward the increased use of electronics and microcomputer control systems. This is especially true with respect to controlling the engine, where many mechanical components have been replaced by electrically operated devices controlled by a microcomputer. With this trend, it became possible to determine the optimum engine valve timing based on the operating conditions occurring at any given point and time. That optimum timing then can be used to activate electrically controlled mechanisms which open and close the intake and exhaust valves for each cylinder.

A typical mechanism for this function employs a separate hydraulic actuator to operate the respective intake valve or exhaust valve. A piston, attached to the stem of the cylinder valve, is driven by hydraulic fluid to move the cylinder valve. The existing lubricating oil for the engine frequently is used as the hydraulic fluid and a separate pump supplies that oil at a greater pressure than the conventional oil pump. A solenoid valve, operated by the engine computer, controls the flow of the hydraulic fluid to and from the piston for the cylinder valve. Thus the solenoid actuator does not directly drive the engine valve, but instead operates a valve member to control relatively high pressure fluid that produces movement of the engine valve. This allows a smaller solenoid actuator to be used than where the solenoid alone would have to supply the force that moves the cylinder valve.

SUMMARY OF THE INVENTION

A hydraulic actuator for operating an engine cylinder valve includes a driver piston to move the engine cylinder valve into open and closed states. A hydraulic valve is in fluid communication with the driver piston, a first conduit carrying fluid at a first pressure, and a second conduit carrying fluid at a second pressure that is less than the first pressure. For example, the second conduit may be connected to a fluid reservoir for the engine. The hydraulic valve has a valve spool which in a first position enables fluid to flow between the first conduit and the driver piston to open the engine cylinder valve, and in a second position enables fluid to flow between the second conduit and the driver piston to close the engine cylinder valve.

An operator, such as an electrically driven solenoid, is operably coupled to produce movement of the valve spool into the first and second positions. A feedback mechanism is coupled to the valve spool, The feedback mechanism responds to movement of the driver piston by moving the valve spool into a third position at which neither the first conduit nor the second conduit is in fluid communication with the driver piston. The feedback mechanism ensures that the stroke of the hydraulic actuator is proportional to the magnitude of the electric current applied to the operator regardless of variation of the pressure in the first conduit.

In one embodiment of the hydraulic actuator, the feedback mechanism comprises a feedback piston which moves in response to fluid pressure produced by movement of the drive piston. A feedback spring extends between the valve spool and the feedback piston. In another embodiment, the drive piston slides within a common bore with the valve spool and the feedback mechanism comprises a feedback spring which extends between the valve spool and the drive piston.

DETAILED DESCRIPTION OF THE INVENTION

Figure 1:
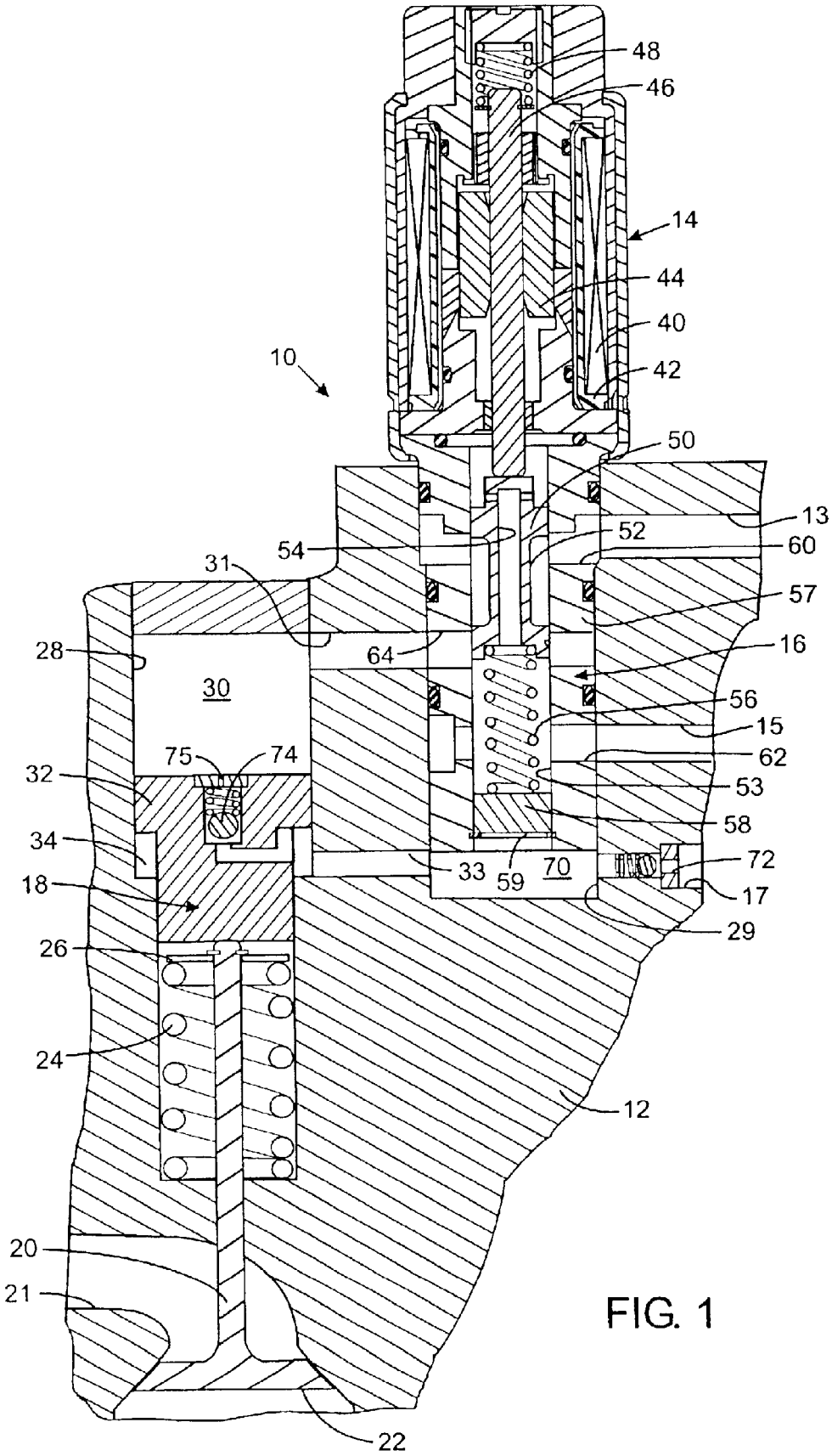
FIG. 1 is a cross sectional view of an engine cylinder valve actuator according to the present invention in which the cylinder valve is closed.

With reference to FIG. 1, the cylinder head 12 of an internal combustion engine has a first bore 28 into which extends the stem 20 of an engine cylinder valve 22. A coil type valve spring 24 is disposed concentrically around the valve stem 20 with one end engaging a surface on the cylinder head 12 and another end engaging a retaining ring 26 affixed to the valve stem. The valve spring 24 biases the engine cylinder valve 22 into the illustrated closed state against a seat formed in the intake or exhaust passage 21 through the cylinder head.

The engine cylinder valve 22 is operated by a hydraulic actuator 10 comprising a hydraulic valve 16 which is opened and closed by a solenoid operator 14 to apply pressurized engine oil to a driver piston 18. The driver piston 18 slides reciprocally within the first bore 28 which forms a drive chamber 30 on a side of the driver piston that is remote from the valve stem 20. The driver piston 18 abuts the cylinder valve stem 20. A head of the driver piston defines a sensor chamber 34 within the first bore 28 on the opposite side of the piston head 32 from the drive chamber 30.

The cylinder head 12 has a second bore 29. A piston conduit 31 connects the drive chamber 30 of the first bore 28 to the second bore 29 and a feedback conduit 33 extends from the sensor chamber 34 to the second bore. A high pressure conduit 13, a low pressure conduit 17 and a tank conduit 15 also extend through the cylinder head 12 and into the second bore 29. The low pressure conduit 17 is connected to the output of the standard oil pump which supplies oil for lubricating the engine components. The high pressure conduit 13 is connected to another pump and receives engine oil at a relatively high pressure as compared to the pressure produced by the standard oil pump. The tank passage 15 extends to the oil reservoir of the engine. Although the exemplary hydraulic engine valve actuator 10 is integrated into bores in the cylinder head 12, a separate enclosure may be provided for the entire actuator or for the solenoid operator 14 and the hydraulic valve 16 components. In the latter case, the cylinder head and that enclosure would combine to form the housing of the hydraulic engine valve actuator.

The solenoid operator 14 and the hydraulic valve 16 are combined into an assembly that is inserted into the second bore 29 in the cylinder head 12. The solenoid operator 14 is of a conventional design comprising an electromagnetic coil 40 wound around an annular bobbin 42 of a non-magnetic material, such as a plastic. A armature 44 is movably received within the central opening of the bobbin 42 and is affixed to an armature shaft 46. An armature spring 48 biases the armature shaft 46 toward the hydraulic valve 16.

The hydraulic valve 16 comprises a cylindrical spool 50 which slides within a circular bore 53 in a valve sleeve 51. The valve sleeve 51 is received within the second bore 29 of the cylinder head 12 and is attached to the solenoid operator 14. A high pressure port 60 in the valve sleeve 51 provides a passage between the bore 53 and the high pressure conduit 13 in the cylinder head 12. A tank port 62 in the valve sleeve 51 provides a passage between the bore 53 and the tank conduit 15. The valve sleeve 51 also has a piston port 64 that provides a path between the sleeve bore 53 and the piston conduit 31 leading to the drive chamber 30. The valve spool 50 has an annular notch 52 in its outer surface and has an aperture 54 extending longitudinally between opposite ends. One end of the spool 50 engages the inner end of the armature shaft 46 and the other end abuts a feedback spring 56 which biases the spool against the armature shaft. The feedback spring 56 also abuts a feedback piston 58 that is slidably held within the bore 53 of the valve sleeve 51 by a retaining ring 59.

FIG. 1 illustrates the engine cylinder valve 22 in the closed state with the solenoid operator 14 de-energized. In this state, the stronger force provided by the feedback spring 56, as compared to the force from the armature spring 48, pushes the spool 50 into a position which blocks the high pressure port 60 and any significant flow of oil from the high pressure conduit 13. It should be understood that in this closed state some leakage of the oil through the valve will still occur. This position of the spool 50 also opens a fluid path from the drive chamber 30 through the piston conduit 31 and the valve sleeve bore 53 into the tank conduit 15. Since the tank conduit is at substantially atmospheric pressure, any pressure within the drive chamber 30 is relieved which enables the valve spring 24 to force the engine cylinder valve 22 against the seat formed in the intake or exhaust passage 21, thereby closing the cylinder valve.

Figure 2:
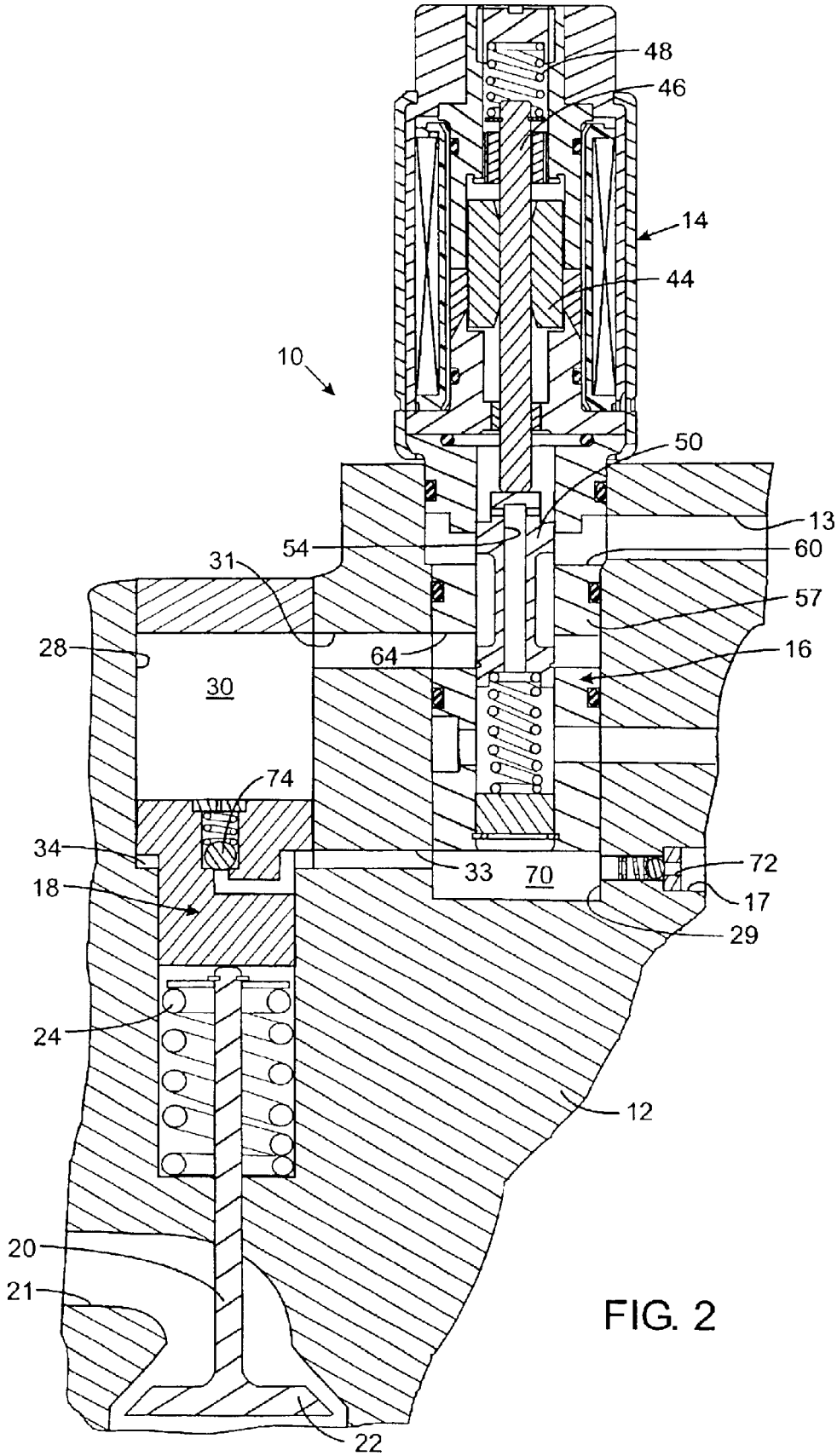
FIG. 2 is a cross sectional view of the actuator while the engine cylinder valve is opening.

Referring to FIG. 2, when the solenoid operator 14 is activated by application of electric current to the solenoid coil 40, the armature 44 and the attached armature shaft 46 are forced in a direction toward the valve spool 50. The force that the armature shaft 46 applies is directly related to the magnitude of the electric current applied to the solenoid coil 40. Thus the oil flow and the resultant rate at which the engine cylinder valve opens and closes can be varied as desired by controlling the rate of change of the electric current. The force of the solenoid operator 14 overcomes the force provided by the feedback spring 56, thereby moving the spool 50 into a position in which the annular notch 52 provides a fluid path between the high pressure conduit 13 and the piston conduit 31. This action applies high pressure oil into the drive chamber 30 which drives the driver piston 18 to push against the valve stem 20. As a result, the engine cylinder valve 22 is forced away from the seat in the cylinder head 12, thereby opening the intake or exhaust passage 21.

The aperture 54 through the valve spool 50 provides a passage between the sections of the sleeve bore 53 on opposite sides of the valve spool. This passage facilitates movement of the valve spool 50 as engine oil can flow through that aperture 54 from one side of the valve spool to the other, thereby eliminating any resistance to the sliding of the spool within the sleeve bore 53 or pressure imbalance.

Figure 3:
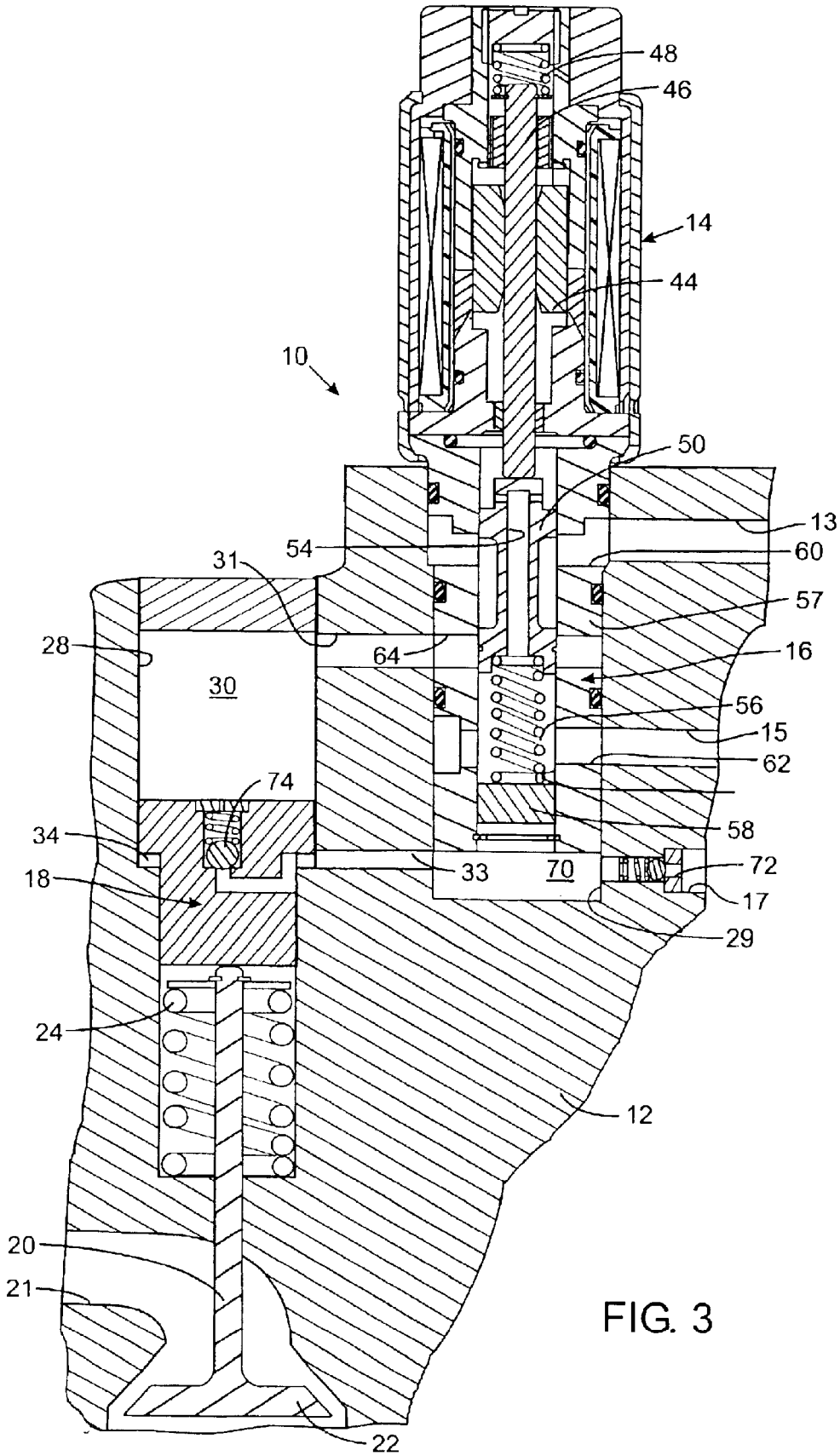
FIG. 3 is a cross sectional view of the actuator in a dwell state when the engine cylinder valve is being held open.

With reference to FIG. 3, the sensor chamber 34, feedback conduit 33, feedback chamber 70, feedback piston 58, and the feedback spring 56 comprise a feedback mechanism which ensures that the stroke of the hydraulic actuator 10 is proportional to the magnitude of the electric current applied to the solenoid operator 14 regardless of variation of the pressure in the high pressure conduit 13. As the driver piston 18 moves downward opening the engine cylinder valve 22, the sensor chamber 34 diminishes in volume as evident from a comparison to the de-energized actuator in FIG. 1. This movement of the driver piston 18 forces the oil that was previously in the sensor chamber 34 through the feedback conduit 33 and into a feedback chamber 70 at the innermost portion of the second bore 29. A first check valve 72 within the low pressure conduit 17 prevents fluid flow from the feedback chamber 70. As a consequence, the pressure within the feedback chamber 70 increases which forces the feedback piston 58 of the hydraulic valve 16 farther into the valve sleeve 51. The movement of the feedback piston 58 compresses the feedback piston 56, thereby exerting a greater force on the spool 50 counteracting the force exerted in the opposite direction by the solenoid operator 14 and armature spring 48. The pressure within the feedback chamber 70, in this state, is such that the force exerted by the feedback spring 50 counterbalances the force produced by the solenoid operator 14 so that the land at one end of the spool 50 extends across and closes the piston port 64 of the hydraulic valve 16. As a consequence, the pressure is held within the drive chamber 30, thereby maintaining the open condition of the engine cylinder valve 22. The magnitude of the feedback force is directly related to the magnitude of the electric current fed to the solenoid operator 14 and correspondingly to the oil pressure in the drive chamber 30. That is, the greater the oil pressure in the drive chamber 30, the farther the driver piston 32 moves thus further compressing the oil in the feedback circuit, i.e. conduit 33 and chambers 34 and 70. Thus the counterbalancing occurs independently of variation of the electric current or of the pressure level in the high pressure conduit 13. The cylinder valve speed can be controlled by ramping the current at a controlled rate.

This state of the hydraulic actuator 10 is maintained until the electric current applied to the coil 40 of the solenoid operator 14 is removed, thereby de-energizing the actuator 10. When this occurs, the electromagnetic force on the armature 44 is removed and the force exerted by the feedback spring 56 moves the spool 50 toward the solenoid operator 14 into the position illustrated in FIG. 1. In this position of the spool 50, a passage is created through the hydraulic valve 16 from the drive chamber 30 to the tank conduit 15 relieving the pressure within the drive chamber. With the release of that pressure from acting on the piston 18, the valve spring 24 returns the engine cylinder valve 22 to the closed position.

Wear of the valve and seat surfaces and the build-up of carbon deposits on those surface cause the position of the valve stem 20 to shift with respect to the actuator 10. That position shift effects the size of the sensor chamber 34 in the closed state, and thus the pressure supplied to the feedback chamber 70 when the cylinder valve is opened. This variation can adversely effect the operation of the feedback mechanism. In addition, should air become entrapped in the feedback circuit, the compressible nature of air also will adversely effect the force provided by the feedback piston 58.

As a consequence, the present engine cylinder valve actuator 10 incorporates a compensation mechanism for the feedback circuit. During the de-energized state shown in FIG. 1, the drive chamber 30 is connected by the hydraulic valve 16 to the tank conduit 15 which is at substantially atmospheric pressure. As a consequence, the first check valve 72 opens, admitting that oil from the low pressure conduit 17 into the feedback chamber 70 and then through the feedback conduit 33 into the sensor chamber 34. The pressure within chamber 34 causes a second check valve 74 to open, enabling the oil to flow into the drive chamber 30 and continue through the hydraulic valve 16 to the tank conduit 15. This flow flushes any air from the feedback circuit and the actuator chamber and fills the feedback circuit with oil, thereby compensating for volume changes due to variation of the cylinder valve position over time. An orifice 75 adjacent the second check valve 74 restricts this flow to a small level so that the lubrication of the engine is not substantially affected.

When the hydraulic valve 16 is again activated by applying high pressure oil from conduit 13 into the drive chamber 30, the second check valve 74 closes because the drive chamber is at a higher pressure than the sensor chamber 34. This traps the existing oil within the feedback circuit as the driver piston 32 causes the pressure in the feedback circuit to increase above that in the pressure conduit 17, thereby closing the first check valve 72.

Figure 4:
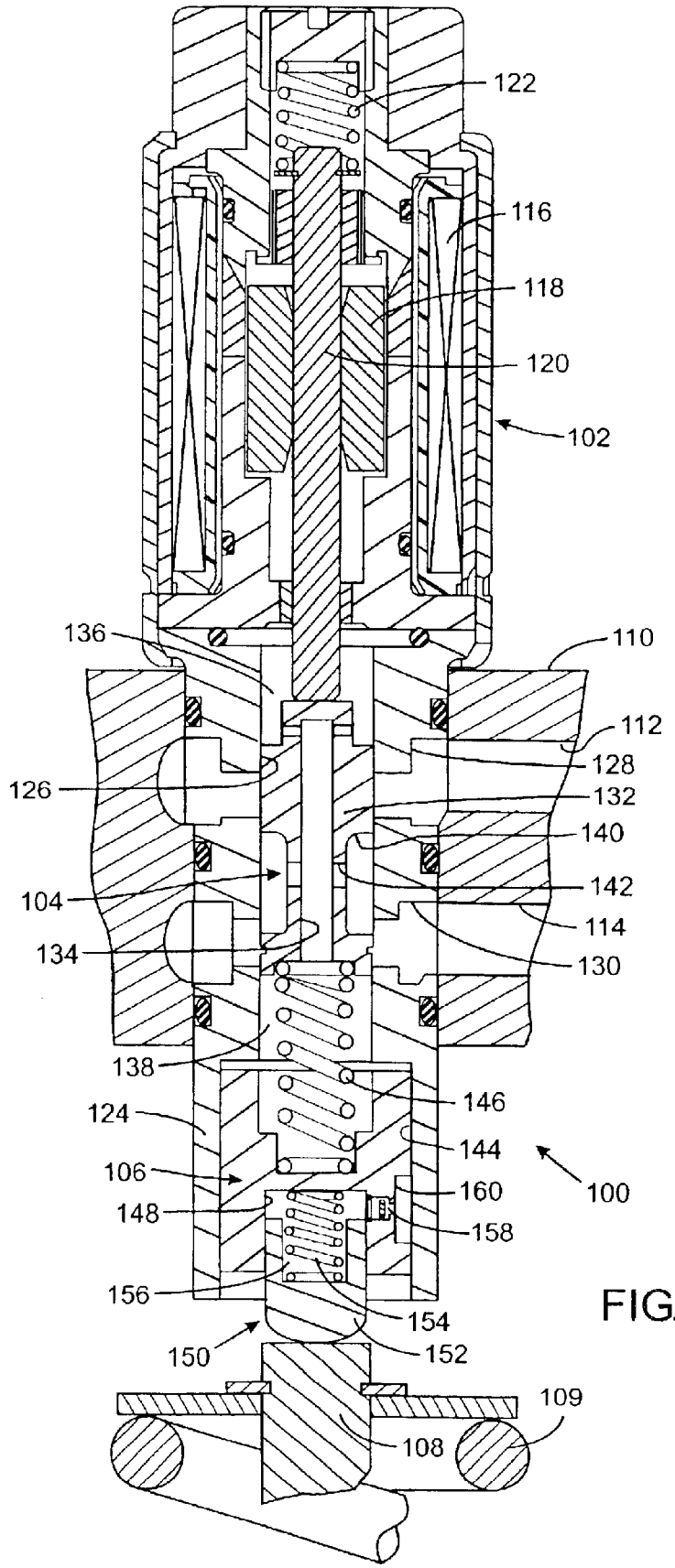
FIG. 4 is a cross sectional view of a second actuator according to the present invention is a state in which the cylinder valve is closed.

With reference to FIG. 4, a second version of a hydraulic engine valve actuator 100 has a solenoid operator 102, a hydraulic valve 104 and a driver piston 106 aligned with the longitudinal axis of the cylinder valve stem 108. The cylinder valve stem 108 is biased by a valve spring 109. The hydraulic engine valve actuator 100 is mounted to the valve cover 110 of the engine. However, unlike conventional valve covers, this valve cover 110 includes a high pressure oil conduit 112 and a low pressure oil conduit 114 which carries engine oil from the conventional oil pump.

The solenoid operator 102 is identical to that described previously with respect to the embodiment in FIG. 1. Specifically, the solenoid operator 102 has an electromagnetic coil 116, which when energized produces a magnetic field that causes movement of an armature 118 that is fixedly attached to an armature shaft 120. An armature spring 122 biases the armature shaft 120 toward the hydraulic valve 104, whereas the magnetic field moves the armature shaft away from the hydraulic valve.

The hydraulic valve 104 has a valve sleeve 124 which is attached to the housing of the solenoid actuator 102 to form a unitized structure. The valve sleeve 124 projects through the valve cover 110. The valve sleeve 124 has an internal circular bore 126, that is connected by a first port 128 to the high pressure conduit 112 and by a second port 130 to the low pressure conduit 114.

A cylindrical valve spool 132 is slidably received within the bore 126 of the valve sleeve 124. The valve spool 132 has an aperture 134 extending from end to end, thereby providing a fluid passage between chambers 136 and 138 formed within the bore 126 on opposite sides of the valve spool. An annular notch 140 extends around the outer circumferential surface of the valve spool 132 and an aperture 142 provides a passage from the bottom of the notch 140 to the end-to-end aperture 134.

A section 144 of the bore 126, in a portion of the valve sleeve 124 that projects beneath the valve cover 110, has a larger internal diameter. The cylindrical driver piston 106 is slidably received within this larger diameter section 144 and is biased away from the valve spool 132 by a feedback spring 146 which engages both of those components. The armature spring 122 exerts a greater force on the valve spool 132 via the armature shaft 120 than the force exerted by the feedback spring 146. An aperture 148 is locate in an end of the driver piston 106 that faces outward toward the cylinder valve stem 108.

A lash adjuster 150 is formed within that aperture 148. Specifically, the lash adjuster 150 comprises a lash piston 152 which slides within the driver piston aperture 148 and is biased outward by a lash spring 154 within a lash chamber 156 at the bottom of that aperture 148. A check valve 158 is located in a passage between the chamber 156 and a recess 160 in the outer surface of the driver piston 106. The check valve permits oil to flow only from the recess 160 into the chamber 156, as will be described.

FIG. 4 depicts the second hydraulic engine valve actuator 100 in a de-energized state where the engine cylinder valve is closed. In this state, the valve spool 132 is biased by springs 122 and 146 into an equilibrium position where the notch 140 opens into the low pressure conduit 114. Oil at that low pressure is conveyed through spool apertures 142 and 134 to the bore chambers 136 and 138 on the opposite sides of the valve spool 132. Because the chambers 136 and 138 on both sides of the valve spool are at equal pressure, the application of the low pressure from conduit 114 does not produce movement of the valve spool 132. Furthermore, the low pressure is insufficient to exert enough force on the driver piston 160 to overcome the valve spring force acting on the engine cylinder valve stem 108 and thus the cylinder valve remains closed.

Figure 5:
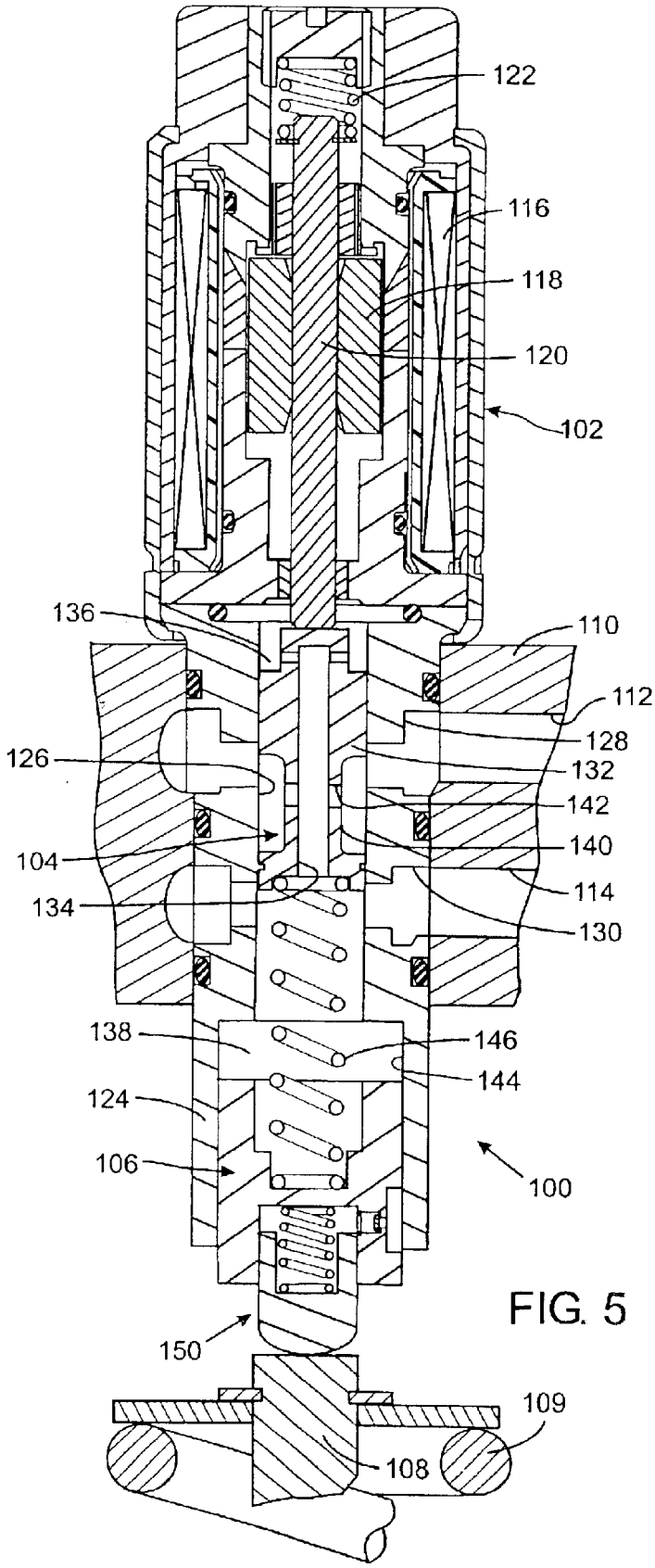
FIG. 5 is a cross sectional view of the second actuator while the engine cylinder valve is opening.

With reference to FIG. 5, application of electric current to the solenoid coil 116 produces an electromagnetic field which causes the armature 118 and the armature shaft 120 to move away from the valve spool 132 (upward in the drawings). The force exerted on the valve spool 132 by the feedback spring 146 keeps the valve spool into engagement with the armature shaft 120 as that latter component moves. Thus, the valve spool 132 moves into a position where its notch 140 communicates with the first port 128, thereby applying high pressure oil from conduit 112 to the valve spool's axial aperture 134. The high pressure oil, conveyed into chamber 138, exerts force on the driver piston 106 which responds by moving outward from the valve sleeve 124. This motion applies force to the end of the cylinder valve stem 108, pushing the engine cylinder valve away from its seat and opening the corresponding intake or exhaust passage (not shown).

Figure 6:
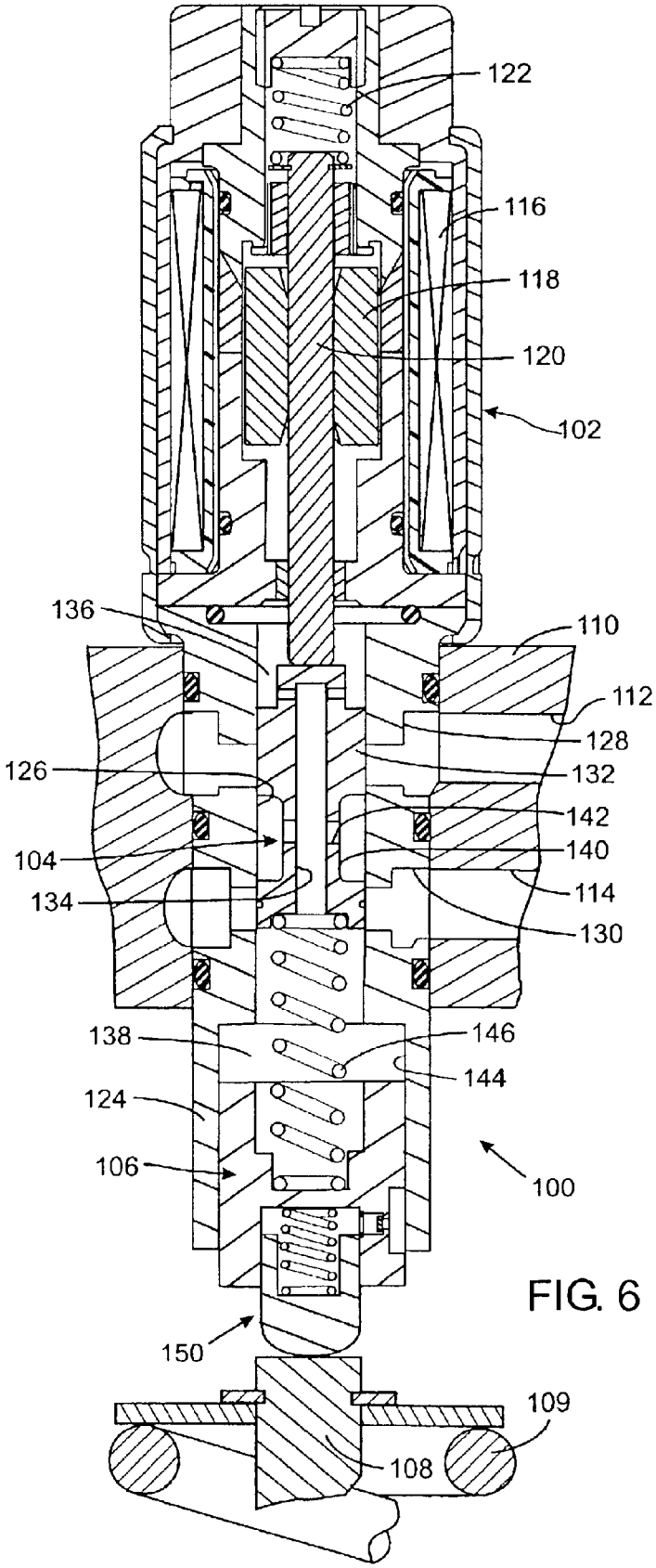
FIG. 6 is a cross sectional view of the second actuator in a dwell state while the engine cylinder valve is being held open.

The second hydraulic engine valve actuator 100 also includes a feedback mechanism which ensures that the stroke of the driver piston 106 is proportional to the magnitude of the electric current applied to the solenoid operator 102 regardless of pressure variation in the high pressure conduit 112. As the driver piston 106 moves outward from the valve sleeve 124, the feedback spring 146 expands, thereby reducing the force that it applies to the valve spool 132. This reduces the aggregate force from the electromagnetic field and the feedback spring which counteracts the force from the armature spring 122. As a result, the armature spring 122 pushes the armature shaft 120 and valve spool 132 toward the driver piston 106 until the feedback spring 146 is compressed sufficiently to increase the aggregate counteracting force to again equal the armature spring force. When that occurs, the valve spool 132 is in a new equilibrium position, illustrated in FIG. 6, where the spool notch 140 is between the first and second ports 128 and 130. In this position, oil from neither the high pressure conduit 112 nor the low pressure conduit 114 can enter that notch 140 and flow into the interior of the valve spool 132. In addition, the existing oil pressure remains trapped within chambers 136 and 138 of the hydraulic valve 104. This trapped oil pressure maintains the extended position of the driver piston 106 which holds the engine cylinder valve open, as long as electric current continues to be applied to the solenoid operator 102.

When electric current is removed from the coil 116 of the solenoid operator 102, the armature spring 122 exerts a greater force on the armature shaft 120 than the counterforce applied by the feedback spring 146. As a consequence, the armature shaft 120 pushes the valve spool 132 downward in the drawings, returning to the position illustrated in FIG. 4 at which the spool notch 140 again communicates with the second port 130. This allows the oil to flow from the hydraulic valve 104 into the low pressure conduit 114, relieving the relatively high pressure in the sleeve bore chambers 136 and 138. The release of that pressure also enables the spring 109, engaging the engine cylinder valve stem 108, to push the driver piston 106 back into valve sleeve 124. This movement of the valve stem 108 also closes the engine cylinder valve.

With continuing reference to FIG. 4, the lash adjuster 150 compensates for the effects of wear and carbon deposits on the engine cylinder valve. As noted previously, when this occurs the position of the end of the valve stem 108 in the closed state changes with respect to the actuator 100. The lash adjuster 150 varies the gap between the driver piston 106 and the lash piston 150 to compensate for that change of the valve stem position over time. It should be understood that operation of the hydraulic valve 104 applies relatively high pressure oil to the chamber 138 adjacent the driver piston 106. Some of this oil leaks out between the driver piston 106 and the inner diameter of the bore 126 in the valve sleeve 124 and into the enclosed region underneath the valve cover 110. Some of the leaking oil fills the recess 160 in the outer surface of the driver piston 106.

If the deposits on the cylinder valve or the mating valve seat cause the valve stem 108 to move downward over time, that movement results in the lash piston 152 moving outward from the driver piston 106 due to the force of the lash spring 154. This movement expands the volume of the lash chamber 156, thereby creating a partial vacuum which draws oil from the recess 160 through check valve 158 to fill the lash chamber 56. Thereafter, when the actuator 100 is energized and the driver piston 106 is pushed downward to activate the cylinder valve, the check valve 158 prevents oil from exiting the lash cylinder chamber 156.

The foregoing description was primarily directed to preferred embodiments of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A hydraulic actuator for operating an engine cylinder valve comprises:

a driver piston to move the engine cylinder valve into open and closed states;

a hydraulic valve in fluid communication with the driver piston, a first conduit carrying fluid at a first pressure, and a second conduit carrying fluid at a second pressure that is less than the first pressure; the hydraulic valve having a valve spool which in a first position enables fluid flow between the first conduit and the driver piston to open the engine cylinder valve and in a second position enables fluid flow between the second conduit and the driver piston to allow the engine cylinder valve to close;

an operator operably coupled to produce movement of the valve spool into the first position and the second position; and a feedback mechanism coupled to the valve spool and responsive to movement of the driver piston by moving the valve spool into a third position at which neither the first conduit nor the second conduit is in fluid communication with the driver piston.

2. The hydraulic actuator as recited in claim 1 wherein the feedback mechanism comprises a feedback spring which applies a bias force to the valve spool which bias force varies in response to movement of the driver piston.

3. The hydraulic actuator as recited in claim 2 wherein the feedback spring extends between the valve spool and the driver piston.

4. The hydraulic actuator as recited in claim 2 wherein the feedback mechanism further comprises a feedback piston which moves in response to a pressure created by movement of the driver piston; and the feedback spring extends between the valve spool and the feedback piston.

5. The hydraulic actuator as recited in claim 1 wherein the hydraulic valve comprises a sleeve with a bore there through within which the valve spool and the driver piston are slidably received, wherein the first conduit and the second conduit communicate with the bore.

6. The hydraulic actuator as recited in claim 5 wherein the feedback mechanism comprises a feedback spring extending between the valve spool and the driver piston.

7. The hydraulic actuator as recited in claim 5:

wherein the driver piston has an exterior surface with a notch therein, an aperture in one end, and a check valve coupling the notch to the aperture; and further comprises a lash piston received in the aperture in the driver piston and a spring biasing the lash piston outward from the driver piston.

8. A hydraulic actuator for operating a cylinder valve of an engine comprises:

a housing having a first bore and a second bore with a piston conduit and a feedback conduit both between the first bore and the second bore, wherein the second bore is in fluid communication a first conduit containing fluid at a first pressure, and a second conduit containing fluid at a second pressure that is less than the first pressure;

a driver piston for operative connection to the engine cylinder valve, the driver piston slidably received within the first bore thereby forming a drive chamber into which the piston conduit communicates and forming a sensor chamber into which the feedback conduit communicates;

a valve spool movably received within the second bore, and having a first position in which the first conduit is connected to the piston conduit and a second position in which the second conduit is connected to the piston conduit;

a feedback piston received in the second bore and moving therein in response to fluid conveyed from the sensor chamber through the feedback conduit and into the second bore;

a feedback spring extending between the valve spool and the feedback piston; and an electrically driven operator operably coupled to produce movement of the valve spool into the first position and the second position.

9. The hydraulic actuator as recited in claim 8 further comprising:

a first check valve which allows flow of a fluid only in a direction from a source into a section of the second bore into which the feedback conduit communicates; and a second check valve which allows flow of a fluid only in a direction from the sensor chamber into the drive chamber.

10. The hydraulic actuator as recited in claim 8 wherein the second conduit is connected to a fluid reservoir of the engine.

11. The hydraulic actuator as recited in claim 8 wherein expansion of the drive chamber reduces the sensor chamber.

12. A hydraulic actuator for operating a cylinder valve of an engine comprises:

a sleeve with a bore there through wherein the bore is in communication with a first conduit containing fluid at a first pressure and with a second conduit containing fluid at a second pressure that is less than the first pressure;

a driver piston slidably received in an end of the bore in the sleeve to move the engine cylinder valve into open and closed states;

a valve spool slidably received in the bore of the sleeve and forming a chamber in the bore between the valve spool and the driver piston, the valve spool having a first position which allows fluid flow between the first conduit and the chamber and a second position which allows fluid flow between the second conduit and the chamber;

a spring in the chamber and biasing the valve spool away from the driver piston; and an operator operably coupled to control movement of the valve spool into the first position and the second position.

13. The hydraulic actuator as recited in claim 12 wherein the second conduit is connected to a fluid reservoir of the engine.

14. The hydraulic actuator as recited in claim 12 wherein the valve spool comprises a first aperture which provides a fluid passage between chambers in the bore on opposites sides of the valve spool, and a second aperture providing a fluid passage between the first aperture and a side surface of the valve spool.

15. The hydraulic actuator as recited in claim 12 wherein the valve spool has two end sections and a side wall between the end sections, a notch extends into the side wall, a first aperture extends between the end sections providing a fluid passage between chambers in the bore on opposites sides of the valve spool, and a second aperture extends between the notch and the first aperture.

16. The hydraulic actuator as recited in claim 12:

wherein the driver piston has an exterior surface with a notch therein, an aperture in one end, and a check valve coupling the notch to the aperture; and further comprising a lash piston received in the aperture in the driver piston, and a spring biasing the lash piston outward from the driver piston.

17. A hydraulic actuator for operating a component on a vehicle, said hydraulic actuator comprising:

a driver piston that moves the component between first and second states;

a hydraulic valve in fluid communication with the driver piston, a first conduit carrying fluid at a first pressure, and a second conduit carrying fluid at a second pressure that is less than the first pressure; the hydraulic valve having a valve spool which in a first position enables fluid flow between the first conduit and the driver piston to move the component into the first state and in a second position enables fluid flow between the second conduit and the driver piston to move the component into the second state;

an operator operably coupled to produce movement of the valve spool into the first position and the second position; and a feedback mechanism comprising a feedback spring engaging the valve spool and in response to movement of the driver piston, the feedback spring moves the valve spool into a third position at which neither the first conduit nor the second conduit is in fluid communication with the driver piston.

18. The hydraulic actuator as recited in claim 17 wherein the feedback spring extends between the valve spool and the driver piston.

19. The hydraulic actuator as recited in claim 17 wherein the feedback mechanism further comprises a feedback piston which moves in response to a pressure created by movement of the driver piston, and the feedback spring extends between the valve spool and the feedback piston, wherein the feedback piston.

20. The hydraulic actuator as recited in claim 17 wherein the hydraulic valve comprises a sleeve with a bore there through within which the valve spool and the driver piston are slidably received, wherein the first conduit and the second conduit communicate with the bore.

* * * * *